United States Patent [19]

Staloff

[11] 4,339,073

[45] Jul. 13, 1982

[54] ENERGY CONSERVING THERMOSTAT

[76] Inventor: Arthur Staloff, 9 Hollis Rd., East Brunswick, N.J. 08816

[21] Appl. No.: 78,104

[22] Filed: Sep. 24, 1979

[51] Int. Cl.[3] ..... F23N 5/20; G05D 23/00

[52] U.S. Cl. ..... 236/46 R; 236/47; 236/94

[58] Field of Search ..... 236/46 R, 47, 94; 165/12, 11

[56] References Cited

U.S. PATENT DOCUMENTS

| | | | |
|---|---|---|---|
| 3,917,165 | 11/1975 | Cross | 236/47 |
| 3,979,060 | 9/1976 | Tierce | 236/46 R |
| 3,995,686 | 12/1976 | Laube | 165/11 |
| 4,013,219 | 3/1977 | Jacobson | 236/46 R |
| 4,049,044 | 9/1977 | Cohen | 236/94 X |
| 4,176,785 | 12/1979 | Allard et al. | 236/46 R |
| 4,186,563 | 2/1980 | Schulze, Sr. | 165/11 X |

*Primary Examiner*—Henry C. Yuen
*Assistant Examiner*—Harry Tanner
*Attorney, Agent, or Firm*—Robert L. Stone; Mel K. Silverman

[57] ABSTRACT

The present invention discloses an energy conserving thermostat for controlling the supply of energy within a commercial or industrial building during unoccupied periods and for providing additional energy to the building when required. The present system includes: a night thermostat for establishing a low temperature necessary for the maintenance of the building during a non-occupancy period; a seven-day timer clock calibrated for every hour of each day, with manually adjustable pins on the clock settable for a time interval within each day during which a normal comfort condition is required; mechanical switch means responsive to such pins of the clock; electrical switch means including a relay energized by operation of the mechanical switch; and an override timer including a time meter and a manually operable switch to increase the time setting for any day wherein an unusual supply of energy is required within a zone of the building. The extra time of such setting is recorded on a time clock meter. The timer clock is provided in a locked box to prevent a tenant from varying the timer clock setting.

3 Claims, 3 Drawing Figures

ENERGY CONSERVING THERMOSTAT

BACKGROUND OF THE INVENTION

The present invention relates to an energy saving thermostat and, more particularly, to an apparatus for controlling the temperature of commercial offices and industrial plants during both occupancy and non-occupancy periods.

The need for an invention of the present class arises from a situation in which most tenants in commercial office space suffer little or no consequence from abusing their control over their thermostats. As a result, temperatures in most offices during non-occupancy periods (usually at night) are not turned down to a suitable temperature, e.g., 40° F. to 45° F., which, if accomplished, would save considerable amounts of energy. Attempts have heretofore been made to improve this situation through the use of various complex systems; however, it has been found that such systems require large investments involving significant alterations of the structure. Landlords are understandably reluctant to make such large investments, as they are uncertain of the return on investment.

Accordingly, the present invention provides ease of installation, elimination of complicated electrical connections, and regulation of tenant use of a buildings' heating and cooling system.

The prior art is represented by such patents as:

U.S. Pat. No. 1,204,090 (1916) to Souder;
U.S. Pat. No. 2,129,878 (1938) to Sambur;
U.S. Pat. No. 2,528,766 (1950) to Marcellus;
U.S. Pat. No. 2,832,870 (1958) to Kucera;
U.S. Pat. No. 3,917,165 (1975) to Cross;
U.S. Pat. No. 3,929,284 (1975) to Prewarski;
U.S. Pat. No. 4,013,219 (1977) to Jacobson; and
U.S. Pat. No. 4,079,366 (1978) to Wong.

The above patents disclose the existence of day-night thermostats and various types of connections and arrangements; however, in each case, application of the prior art devices has not been fully adequate to meet the needs of the landlords owning commercial offices and industrial plants.

Also, the prior art does not disclose any efficient arrangement for recording an excess use of energy by a tenant or for tying-in an override timer to a night thermostat. Connection of the same to an existing system, as is hereafter disclosed, would clearly be to the owner's economic benefit.

Accordingly, it may be appreciated that a need for an energy-conserving apparatus of the present type has long existed in the prior art.

SUMMARY OF THE INVENTION

The present invention relates to an energy-conserving thermostat for controlling the temperature in a heating zone and recording the use of any excess energy therein. The invention comprises: (a) a night thermostat establishing a temperature necessary for non-occupancy maintenance of the zone during off-hours; (b) a seven-day timer clock, calibrated for time of each day, having manually adjustable pins on said clock for setting a time interval of each day, during which normal comfort conditions are required; (c) a mechanical switch means responsive to the pins of said clock; (d) an electrical switch means including a relay energized by the operation of the mechanical switch means; and (e) an override timer including a time-clock meter and a manually operable switch for increasing the time on any given day when an unusual supply of energy is required in said zone, such time being recorded on the clock meter.

It is an object of the present invention to fill a major need in the area of energy conservation.

It is another object to prevent the undue waste of the energy which occurs in most commercial use of heating and air-conditioning in office buildings and industrial plants.

It is a further object to provide a low cost, light weight, portable, and easily-installable energy conservation system.

It is yet a further object to provide a control over tenants in office buildings with respect to use of thermostats.

It is still a further object to provide means to prevent a tenant from varying the timer clock settings while the override timer permits him to obtain additional required energy for periods which can be monitored by a landlord.

Other objects and advantages of the present invention will become apparent from the hereinafter set forth Detailed Description of the Invention.

DETAILED DESCRIPTION OF THE INVENTION

In accordance with the present invention, the apparatus 10 is constructed so that it may be mounted upon a supporting surface, such as a wall, adjacent to a standard thermostatic control unit 14 of a type having access to an electric outlet typically found in a heating and/or cooling system of an office building. The thermostatic control unit 14, usually a day thermostat, is designed to operate from a low of about 58° F. to 80° F. A night thermostat 12 is provided to operate in a lower range of temperatures such as 40° F. to 45° F., inasmuch as a temperature of more than 45° F. is generally not required for the usual maintenance of any area of an office building, warehouse or industrial plant, whenever it is essentially unoccupied.

The prior art thermostat 14 is a high temperature thermostat, designed to operate at a higher temperature and, particularly, to be set about 65° F.to 80° F., typically about 68° F. to 70° F. (for heating), to allow a normal comfort condition during an occupancy period. Each of the thermostats is of the usual type in that they may be set to open or close at a predetermined selector temperature to effect operation of a heating or air-conditioning unit.

Figure 1:
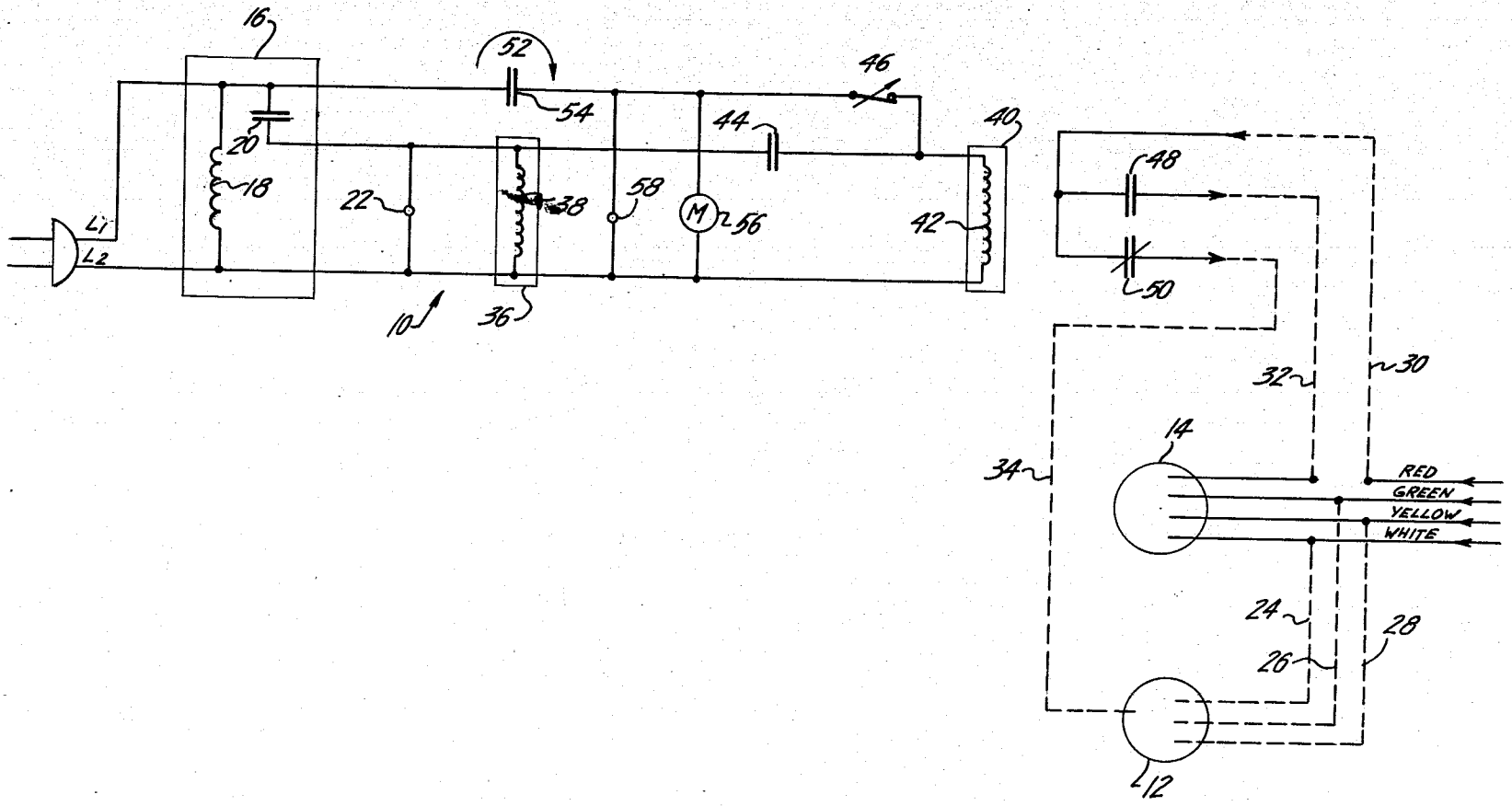
FIG. 1 is a schematic wiring diagram showing the connections of an energy-conserving means to a night thermostat.

The present energy conservation apparatus is generally shown in FIG. 1 as element 10. The components of the apparatus 10 are schematically shown and connected to a power source and also to the wires coming from a furnace (not shown). The apparatus 10 is typically positioned in a room remote from the furnace.

The apparatus 10 includes a seven-day timer 16 having a clock motor 18, and a mechanical switch means 20. The clock motor operates on a continuous twenty-four hour basis. Power supply lines L1 and L2 are connected in order to operate the clock motor 18 and to energize a green indicator light 22.

The existing thermostat 14 exhibits four connections as represented by wires colored red, green, yellow and white, the same representing respectively a power line, a fan line, an air-conditioning line and a temperature heat line, the line being tapped as shown in FIG. 1. The green, yellow, and white wires are connected to the night thermostat 12 through conductors 24, 26 and 28. A conductor 30 is connected between the red wire, the connection being between the furnace and the apparatus 10. Similarly, return conductors 32 and 34 are connected from the pre-existing thermostat 14 and the night thermostat 12, to the apparatus 10.

The apparatus 10 also includes a relay 36 having a coil 38, and a relay 40 having a coil 42. The relay 36 has a normally-open contact 44 and a normally closed contact 46. The relay 40 exhibits a normally-open contact 48 and a normally-closed contact 50. Further, an override timer, usually a twelve-hour incremental timer 52 with a manually operable switch 54, a time clock meter 56, and a red light 58 are connected as shown. The red light will indicate whether the override timer is on. The time clock meter 56 records time intervals in one-tenth hours. Relays 36 and 40 and red light 58 are energized by power supply lines L1 and L2.

Figure 3:
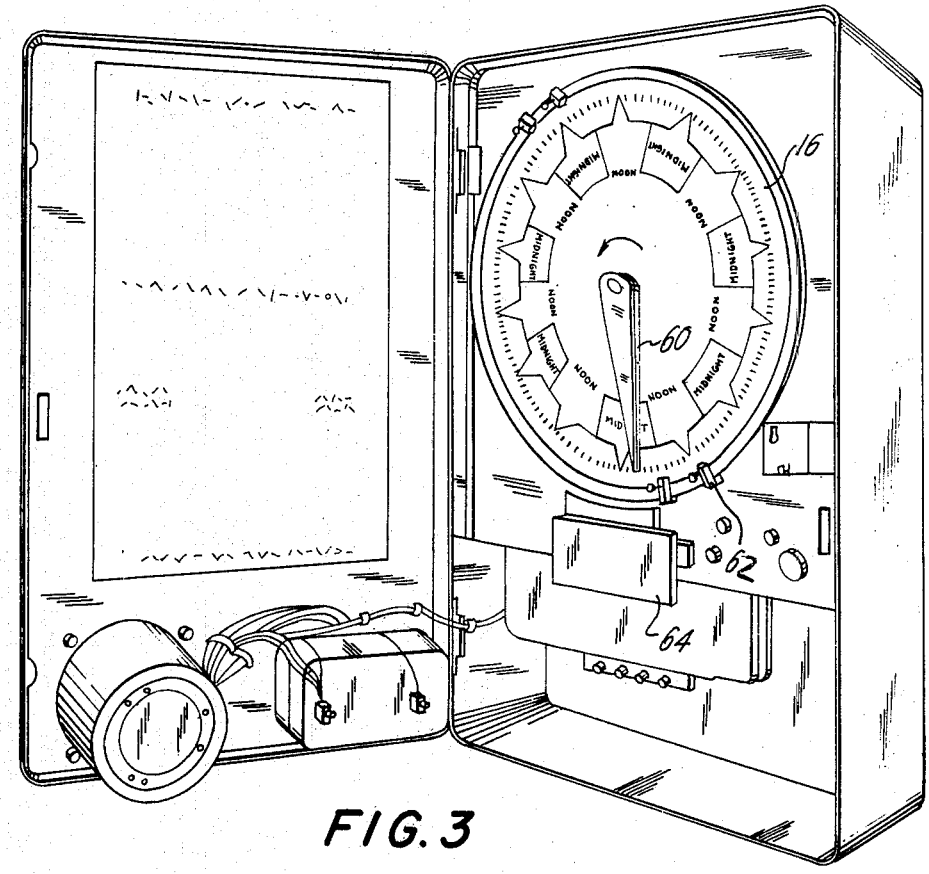
FIG. 3 is a perspective view of one mechanism of the apparatus inside the enclosure.

As shown in FIG. 3, the seven-day timer clock 16 is calibrated for every hour of each day, on a seven-day schedule, and is equipped with manually-adjustable pins 62, consisting of dial trippers and tripper screws in which, when the tripper screw is inserted in an engaged "ON" position is visible and thereby becomes the "ON tripper". For simplicity, pins are shown in position for only two days in FIG. 3. When the tripper screw is inserted from the other side so that "OFF" is visible, it becomes an "OFF tripper". On a seven-day schedule, typically fourteen pins may be required assuming one continuous occupancy during the day-time. The pins may be installed on a circular surface of the dial, as may be desired, representing the time periods, including the occupancy period, during which desired comfort conditions and the remaining time period, usually a non-occupancy period may be established. These pins should be installed tightly against the dial. When a time pointer 60 reaches a particular set time on the dial on a given day, a mechanical switch means 64 responsive to the pins on the dial, will be actuated by conventional means (not shown), which in turn will energize the relay and closes or opens a circuit causing the night thermostat or the existing day thermostat to operate and, thus, the desired temperature during the occupancy and non-occupancy periods will be attained.

The usual power supply of 120 V, 60 Hz, activates the seven-day timer clock 16, the green indicator light 22, and the coil 38 of the relay 36. The normally-closed contact 46 opens, and the normally open contact 44 closes. When the contact 44 closes, the coil 42 is activated and the contact 48 closes, while contact 50 opens. Thus, the night thermostat 12 and the twelve-hour incremental timer 52 are switched out of a circuit and the existing day thermostat 14 is switched in the circuit. At the completion of an interval of time during occupancy, the manually adjustable pin 60, in the OFF position, opens the clock contact; relay coils 38 and 42 are de-energized, contacts 46 and 50 close, contacts 44 and 48 open, the green indicator light 22 goes off, the night thermostat 12 enters into the circuit, and the day thermostat 14 leaves the circuit.

When a tenant desires to stay in his office, or wishes to occupy his office during an otherwise OFF cycle, he may set the interval timer 52 by a manually-operable switch 54. Any time the interval timer 52 is activated, a red indicator light 58 goes on and a non-resettable elapsed-time recorder, included in a front panel, initiates counting. If the tenant chooses an excessive interval to remain in the office, he may reset the timer to zero; in that case he will be charged only for the extra time he has remained in the office. He will prefer to do that as he has to pay for the extra time he chooses to stay in the office. When he actuates the interval timer 53, the relay coil 42 is activated; contact 48 is closed and contact 50 is open; the day thermostat 14 enters the circuit and the night thermostat 12 leaves the circuit. When the interval timer is reset to zero; the red light 58 goes off, contact 50 is closed and contact 48 is open. The day thermostat 14 is out of the circuit and the night thermostat 12 is in the circuit.

Figure 2:
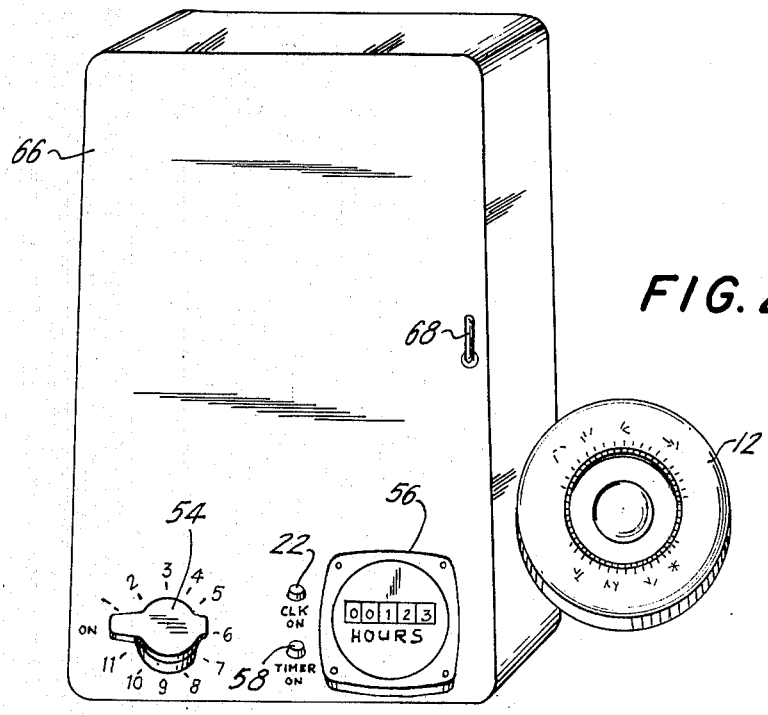
FIG. 2 is a plan view of the apparatus in an electrical enclosure, showing the time-clock meter, the switch and the night thermostat.

As shown in FIG. 2, the apparatus 10 is enclosed in a locked box 66 with a lock 68, in order to prevent a tenant from varying the settings of the timer clock. The manually operable switch 54, the time clock meter 56, the green light 22, and the red light 58 are installed outside a front panel of the box 66, while the seven-day timer clock 16, the mechanical switch means 20, electrical switch means including relays 36 and 40, are installed and connected inside the box 66.

In accordance with the connections as shown in FIG. 1, and particularly, the green, yellow, and white wires connected to the night thermostat 12 through conductors 24, 26, and 28, will also provide controlled cooling during hot nights. Thus, a normal comfort condition with respect to heating and cooling, as required, is efficiently obtained through a system as described hereinbefore. Further, if only the heating control is desired and the air cooling is not involved, the connections can be made simple by connecting the green and yellow wires to the existing thermostat 14, and not to the night thermostat 12 through conductors 26 and 28 as shown in FIG. 1.

The word "energy" as used hereinbefore comprises fuels and electricity for providing heating and air-conditioning.

It is understood that the seven-day timer clock can be modified to include a spring operated time advance mechanicm which automatically recoils whenever power is available. In the event of a power failure, this would permit the timer clock to continue to operate and avoid the need to reset the clock.

In a preferred embodiment of the invention, the elapsed time recorder or an additional elapsed time recorder can be installed remotely from the apparatus. This would permit a landlord to read the timer 52 without physically entering the tenant's premises.

While reference has has been made to commercial offices and industrial plants which customarily have non-occupancy periods, the apparatus can also be used in residential situations. For instance, when a landlord includes electricity costs in the rent, the apparatus can be provided with appropriate day and night temperature settings inside the locked box and the tenant can use the override timer to increase his desired energy use, which the landlord can monitor and charge for it to the tenant.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. An apparatus for controlling the supply of energy in a heating zone and recording any excess supply of the energy, when required in said zone, comprising:

(a) a day thermostat allowing a temperature necessary for normal comfort conditions during an occupancy period;

(b) a night thermostat allowing a temperature necessary for a maintenance of said zone during a non-occupancy period;

(c) a seven-day timer clock calibrated for time of each day with manually adjustable pins on said clock to set a time interval on each day during which normal comfort conditions with the day thermostat are required;

(d) a mechanical switch means responsive to the pins of said clock;

(e) an electrical switch means including a relay energized by an operation of said mechanical switch means; and (f) an override timer including a time clock meter and a manually operable switch to increase the time on any given day when a usual supply of energy is required in said zone; said time being recorded on the time clock meter.

2. The apparatus as recited in claim 1, further comprising: a locked box inside which said seven-day timer clock, mechanical switch means, and electrical switch means are connected; and said override timer comprising the timer clock meter and the manually operable switch are mounted from the inside to outside of said box.

3. The apparatus as recited in claim 1 in which the manually operable override switch, when in the "on" position, activates a relay that simultaneously disconnects the night thermostat and connects the day thermostat and energizes the recording clock meter.

* * * * *